United States Patent [19]

Payne

[11] 4,188,847

[45] Feb. 19, 1980

[54] METHOD AND APPARATUS FOR PERFORATING AN ASSEMBLED FILTER USED ON A SMOKING PRODUCT

[75] Inventor: Leslie E. Payne, Winston-Salem, N.C.

[73] Assignee: R.J. Reynolds Tobacco Company, Winston-Salem, N.C.

[21] Appl. No.: 859,615

[22] Filed: Dec. 12, 1977

[51] Int. Cl.[2] ..... A24C 5/50

[52] U.S. Cl. ..... 83/868; 83/866; 83/170; 131/23 R; 131/170 R

[58] Field of Search ..... 83/866, 868, 867, 170; 131/23 R, 170 R

[56] References Cited

U.S. PATENT DOCUMENTS

| | | | |
|---|---|---|---|
| 3,831,476 | 8/1974 | Noren et al. | 83/170 |
| 3,847,044 | 11/1974 | Rudszinat | 83/868 |
| 4,061,148 | 12/1977 | Goslin et al. | 83/868 X |

*Primary Examiner*—Donald R. Schran
*Attorney, Agent, or Firm*—Grover M. Myers

[57] ABSTRACT

This invention relates to a method and apparatus for perforating the walls of an assembled filter element used on smoking products including a continuously moving conveying means for receiving a plurality of said filter elements and means for retaining said assembled filter elements on said conveying means, a plurality of piercing elements positioned at right angles to the direction of movement of said assembled filter elements, and a means for manipulating the piercing elements so that it penetrates and withdraws from the walls of the filter element.

24 Claims, 18 Drawing Figures

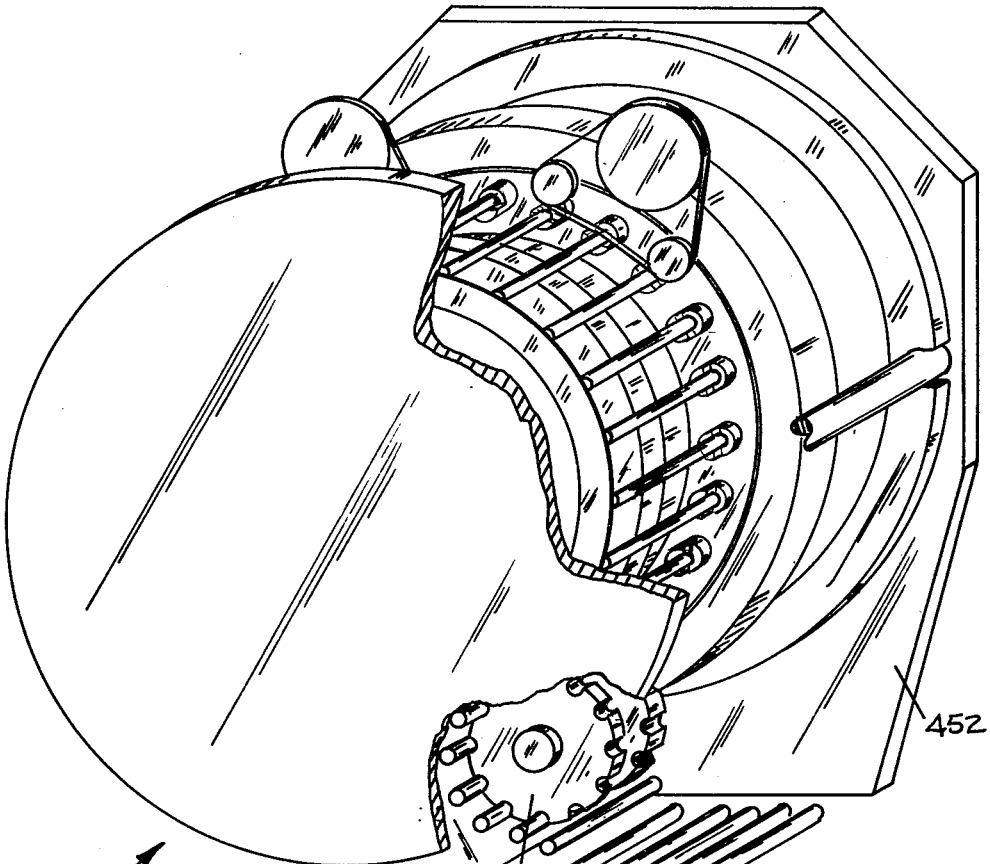
452

METHOD AND APPARATUS FOR PERFORATING AN ASSEMBLED FILTER USED ON A SMOKING PRODUCT

BACKGROUND OF THE INVENTION

This invention relates to an apparatus for perforating filters used on smoking products, and in particular, cigarette filters.

In the past, many cigarettes have been developed which use air dilution in order to reduce the concentration of constituents or tar in the smoke from cigarettes, cigars or other smoking devices. These cigarettes are now commonly known as low "tar" products. Many of these smokeables were developed without any thought being given to their possible production in commercial quantities. As it turns out, many of these previously developed cigarettes could not be produced in commercial quantities at a price low enough to make them available to consumers; therefore, they were not utilized.

Another problem which has existed in producing the lower tar cigarettes is a requirement for uniformity of result. Under today's labeling requirements, each cigarette must have approximately the same "tar" level which is advertised for that particular brand. For this reason, any type of cigarette filter design which uses air dilution to obtain its "tar" numbers must have the capability of being duplicated precisely so that the air flow characteristics of the filter will be uniform. It is difficult to obtain precise air flow characteristics and maintain the manufacturing speeds necessary to make the production of such low "tar" products economically feasible.

There are some low "tar" cigarettes which do not use air dilution to maintain the required uniformity of tar level but use a specially designed filter. These types of low "tar" products are extremely expensive to produce because of the cost of the filter material and processing techniques.

Thus, one of the most efficient and economical ways presently known to reduce the "tar" level in cigarettes as well as maintain the uniformity of results required is by the use of air dilution techniques. As low "tar" cigarettes become more widely accepted, air dilution techniques will become more and more important. In the past, the tobacco industry has primarily utilized a pre-perforated tipping material with a porous overwrapping on the filter plug of cellulose acetate to allow air to be drawn into the smoke stream. The tipping is normally perforated by mechanical or electrical methods prior to being placed on the filter cigarette assembling machine. Although this method has given adequate results in maintaining uniformity and permitting relatively high machine operating speeds, some problems do exist. For example, special spacing patterns for the glue have to be employed to insure that the perforations are not closed when the tipping is attached to the filter. These patterns usually leave a relatively wide glue-free strip on the tipping coinciding with the row of perforations. This glue-free strip causes the tipping not to be sealed along the entire seam, producing a raised portion which can produce malfunctions in the assemblies and produce a leakage area.

The thin porous overwrap which must be used with the pre-perforated tipping has been a source of manufacturing downtime. The porous overwrapping web has to be thinner than the overwrap normally used to allow the passage of air into the cellulose acetate plug. It, therefore, has less tensil strength. The porous overwrap web often breaks during high-speed production because of this decreased tensil strength, causing considerable production downtime.

In order to overcome the gluing problem and the overwrap breakage problem mentioned above, attempts have recently been made to perforate cigarette filters after they have been assembled and attached to the tobacco rod. There is now available a device including a mounting block with a series of needles which is attached to the high-speed assemblers to perforate filter cigarettes already formed. After the cigarette is made, it is rolled over the needle assembly so that the filter is pierced by the needles. In this way, the perforations occur after the gluing step and the overwrap which is perforated with the tipping can be a standard overwrap rather than a porous overwrap. This technique has been found to be totally unsatisfactory at high machine speeds because the needles tear the tipping and, thus, do not provide the uniformity of air flow levels that is required.

Thus, a need has existed within the tobacco industry for a device which will perforate assembled filter elements either after they have been assembled as a unit by a plug tube combiner or after the filters or mouthpieces have been attached to the tobacco rod at production rates of between 3000 to 5000 units per minute and which will duplicate the uniform air dilution rate which is necessary to manufacture low "tar" cigarettes.

SUMMARY OF THE INVENTION

It is, therefore, an object of this invention to provide a method and apparatus for perforating assembled filter elements for smoking products.

Another object of this invention is to provide an apparatus which will perforate a filter or mouthpiece of a filter cigarette after it has been attached to the tobacco rod.

Another object of this invention is to provide an apparatus which can be utilized with a high-speed filter cigarette assembler or a plug tube combiner and which can be driven directly by the assembler or combiner or can be driven as a separate unit.

Another object of this invention is to provide an apparatus which will produce a filter for a smoking product having a uniform air dilution level.

Another object of this invention is to provide an apparatus which can produce a desired number of perforations at desired peripheral location, size and shape.

Another object of this invention is to provide a perforating apparatus which can eliminate the improper gluing and overwrap breakage problems which have been previously encountered in the manufactured of air dilution smoking products using pre-perforated tipping paper.

Still another object of this invention is to provide a perforating apparatus which can not only be utilized with the standard cellulose acetate filter but also be used to perforate a rigid tubular mouthpiece made of plastic or multilayer paper.

These and other objects are accomplished by the present invention through the use of a continuously moving conveyor, more particularly a rotating drum which receives and transports assembled filter elements as they are perforated one or more times. A plurality of retaining holder sets which engage each end of the assembled filter elements are used to maintain the elements in the proper position as they are perforated. A plurality of plungers, one being located adjacent each set of retaining holders, and disposed angularly, normally perpendicular, to the axis of the element, reciprocates to cause a probe or needle carried on the plungers to pierce the filter to form an aperture in the sidewall thereof.

Additionally, the present invention includes a turning device for rotating the filter element an angular distance between reciprocation of the plungers whereby a plurality of perforations can be made in the filter at selected angular locations around the element's periphery. Heating elements are also provided to heat the probes to a selected temperature in order to more easily perforate the filter if a rigid material such as plastics or multilayer papers is used in the filter construction.

BRIEF DESCRIPTION OF THE DRAWINGS

FIGS. 2A and 2B are cut-away perspectives of two embodiments of the filter perforating apparatus according to the present invention as shown in FIGS. 1A and 1B, respectively.

DESCRIPTION OF A PREFERRED EMBODIMENT

Figure 1A:
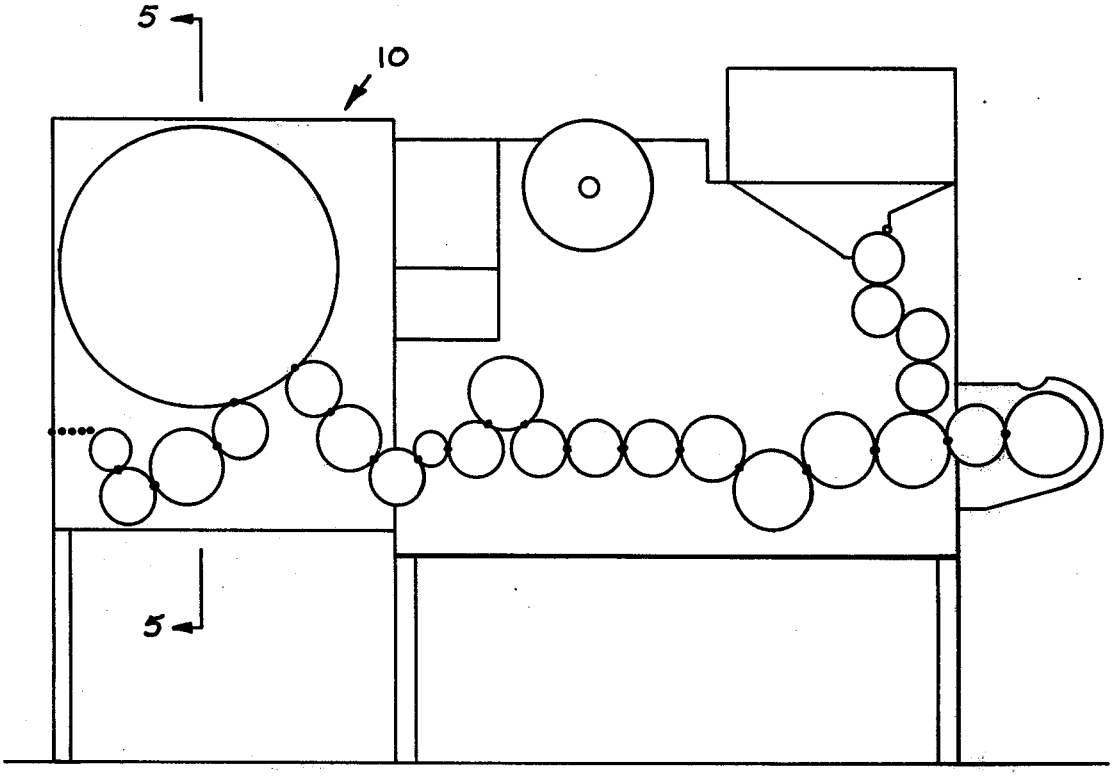
FIGS. 1A and 1B are diagramatic elevations showing the location of the perforating drum with respect to two presently known cigarette assemblies manufactured by Hauni-Werke Korber & Co.
Figure 1B:
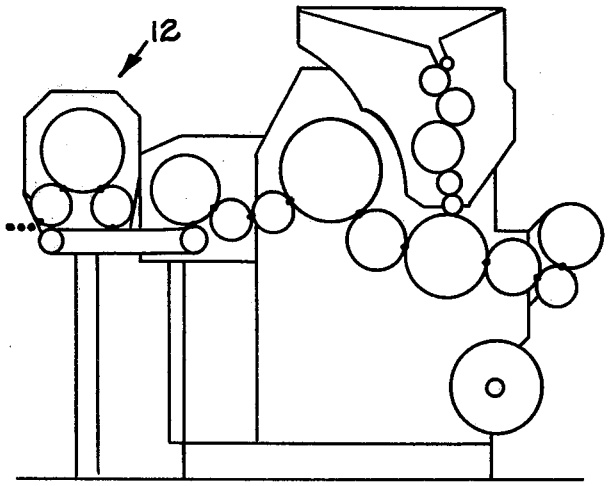
Figure 2A:
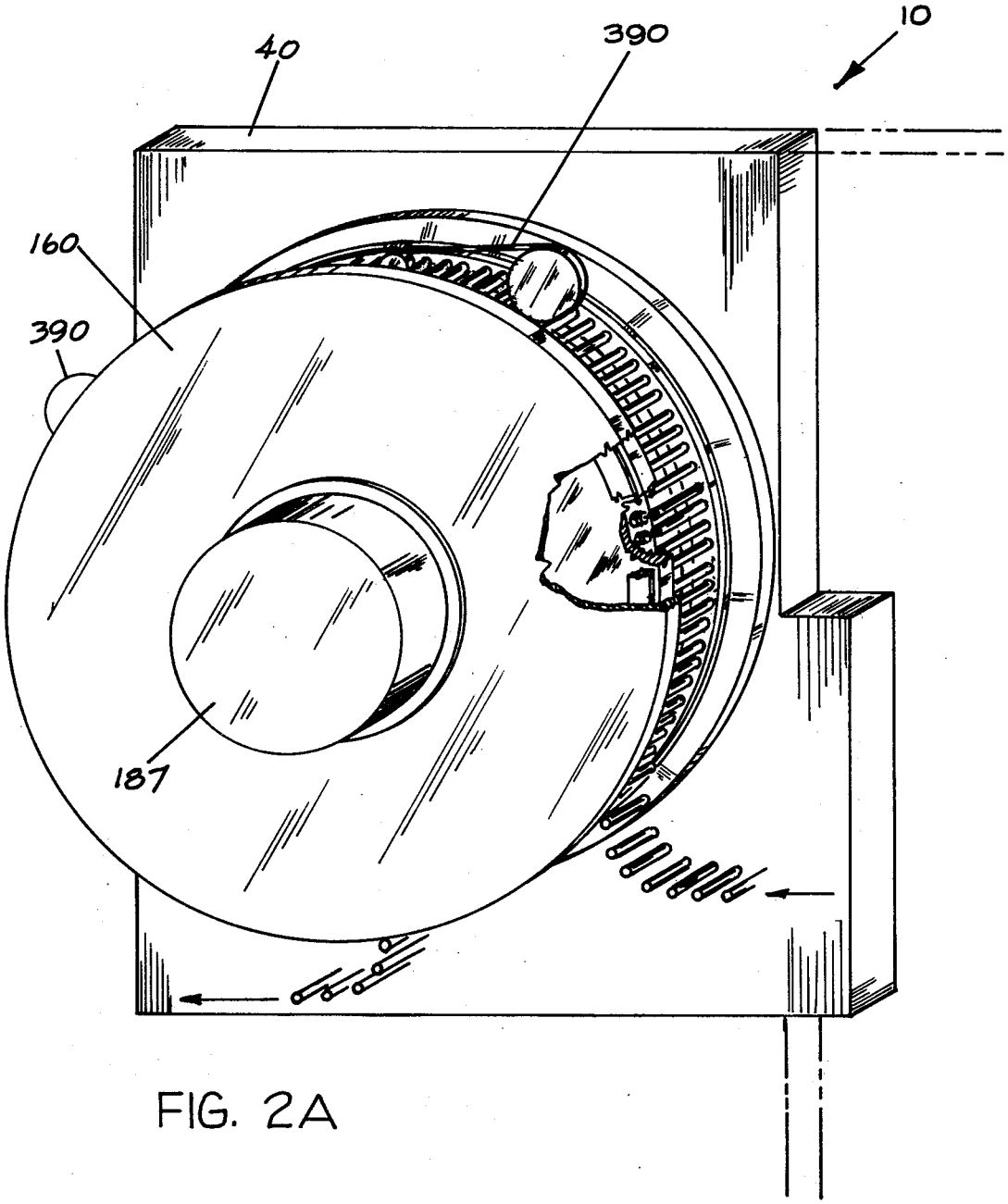

Referring more particularly to the drawings, FIGS. 1A and 2A and 1B and 2B illustrate two embodiments of a perforating drum 10 and 12, respectively, and their respective locations on a high-speed filter cigarette assembler such as Max-S manufactured by Hauni-Werke Korber & Co. and an older version of the Max assembler (Max) produced by the same manufacturer. It should be understood that these perforating drums can be attached to any type of filter cigarette assembler such as the PA-8 produced by Molins Machine Company, Limited or if desired can be a separate unit; however, for the most economical and efficient use of the perforating unit, it should be attached directly to the filter cigarette assemblers. Each of the filter cigarette assemblers mentioned above shall be referred to hereinafter as an "assembler." FIG. 1A illustrates the location of a perforating drum which is attached to an assembler but is driven by separate drive means, while FIG. 1B illustrates a perforating drum attached to an assembler and driven by the assembler drive.

Figure 4:
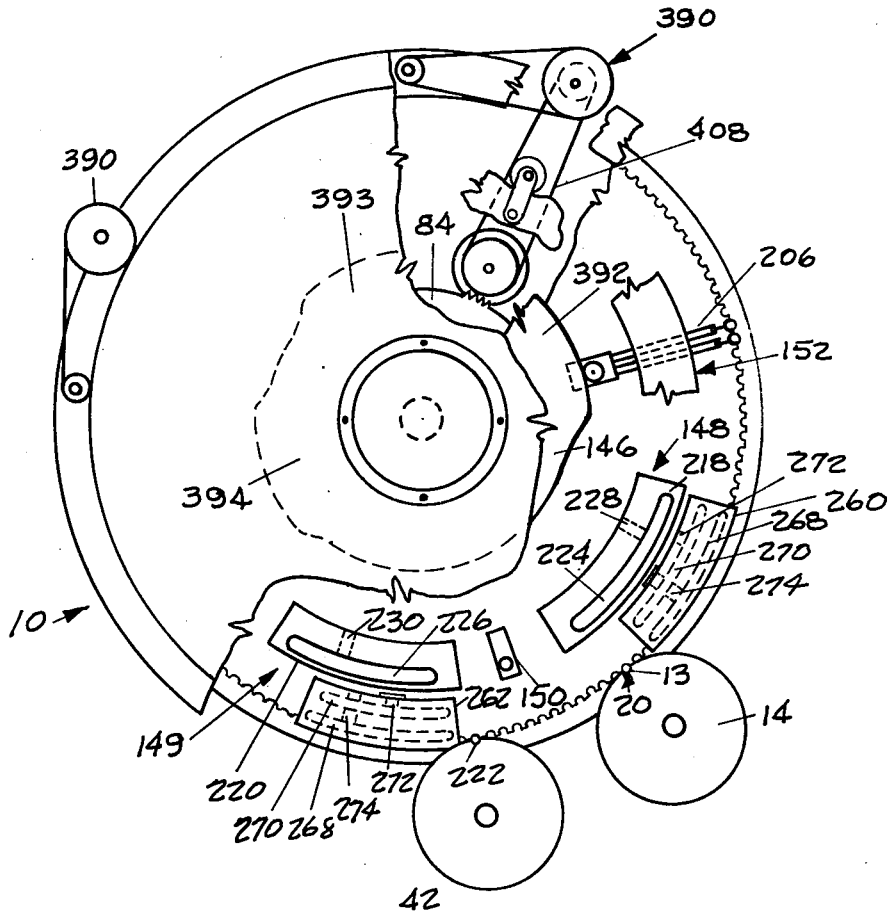
FIG. 4 is the schematic front elevation view of the rotatable perforating drum and its associated transfer drums with portions of the perforating drum cut away to show the perforating plunger mechanism and the vacuum and positive air control segments.
Figure 5A:
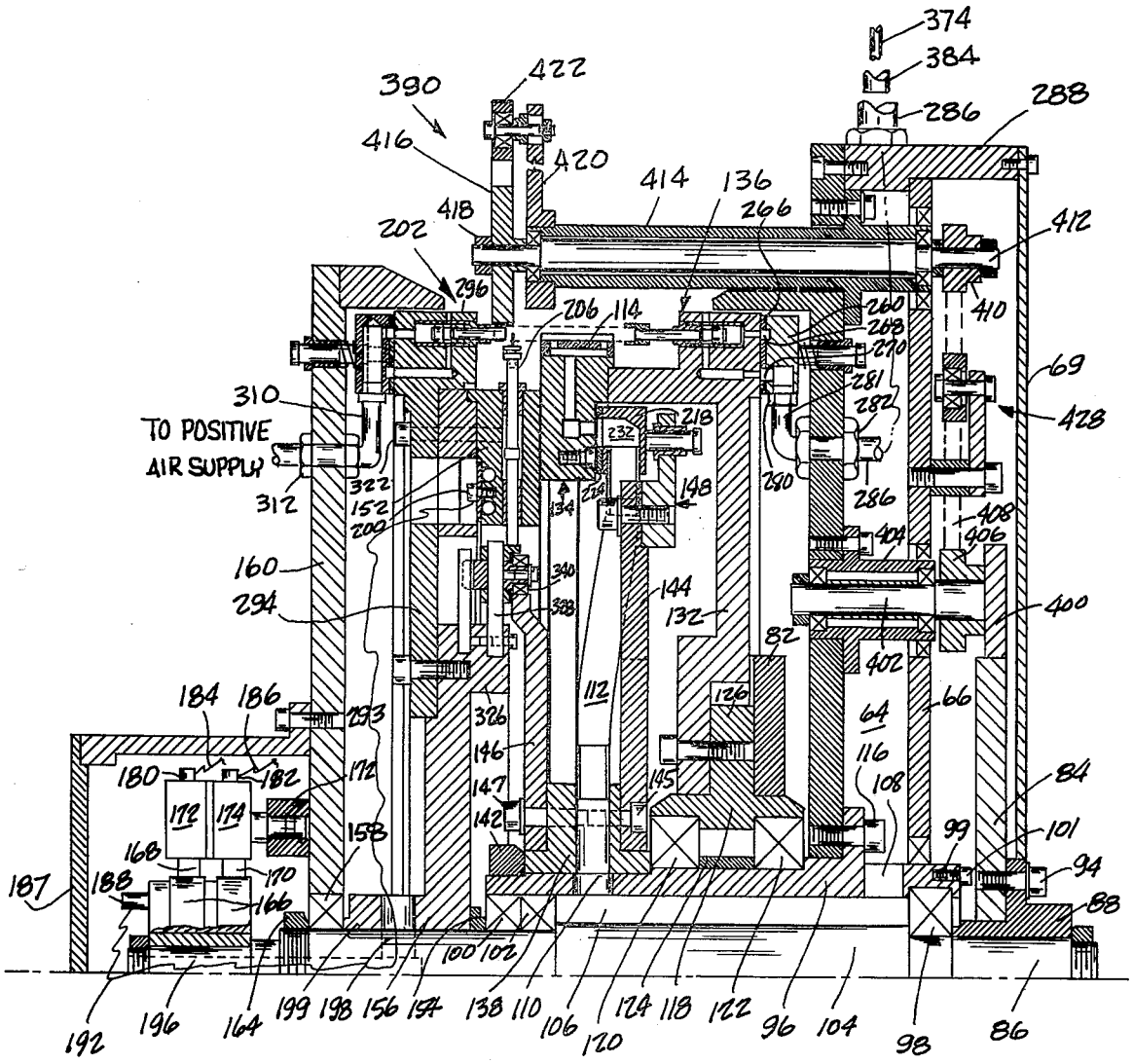
FIGS. 5A and 5B are a divided conventional revolved section view taken along line 5—5 of FIG. 1A.
Figure 5B:
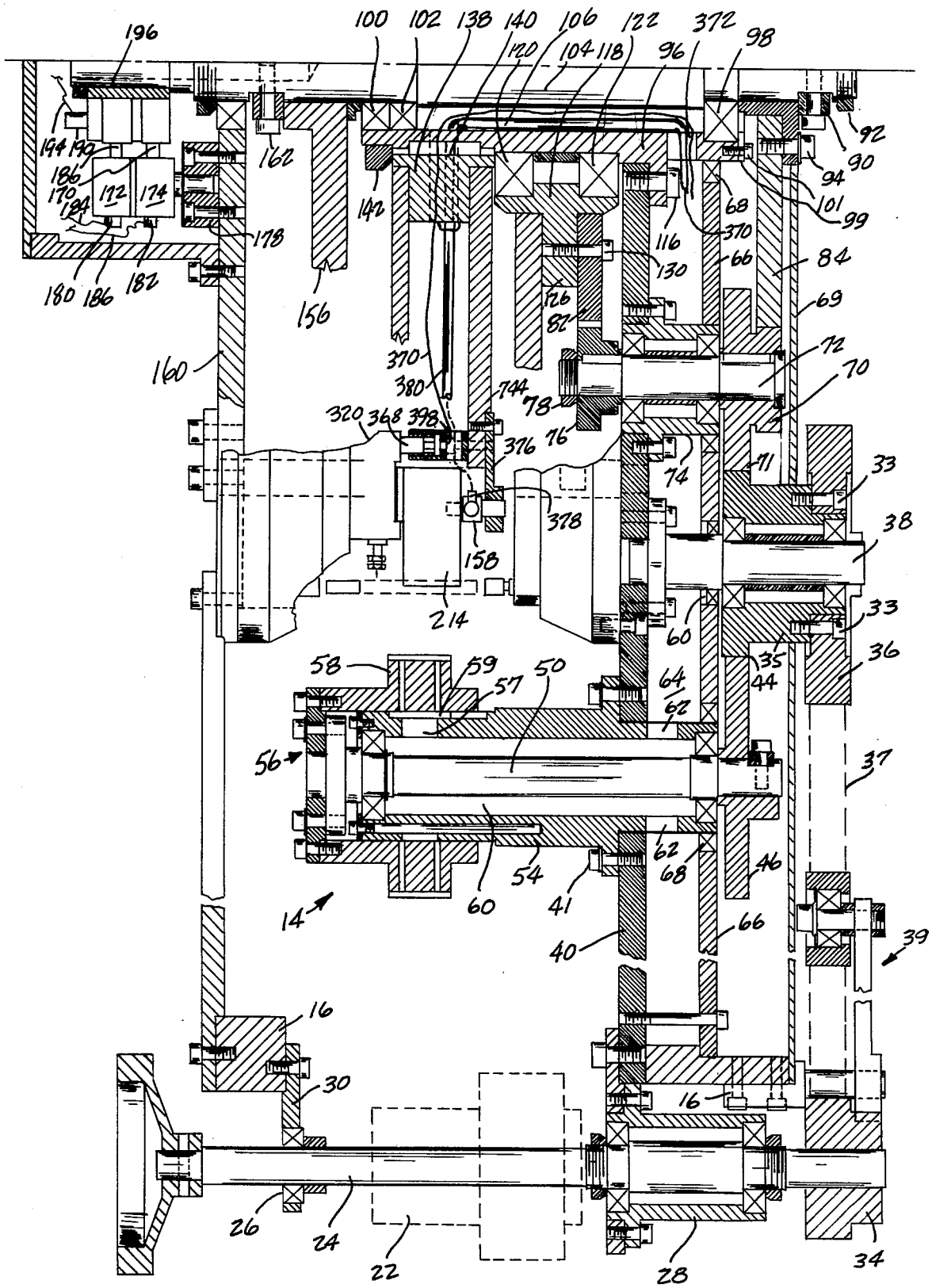

As can be seen in FIG. 4, the assembled filter cigarettes 13 which includes a tobacco rod and a non-recessed filter or a recessed mouthpiece united by a tipping band are transferred at point 20 from a standard transfer drum 14 to the perforating drum 10 which is mounted on a stand or support 16 (see FIG. 5B). When viewing FIGS. 5A, 5B and 9, the rear of the perforating drum is on the right and the front is on the left.

Figure 3:
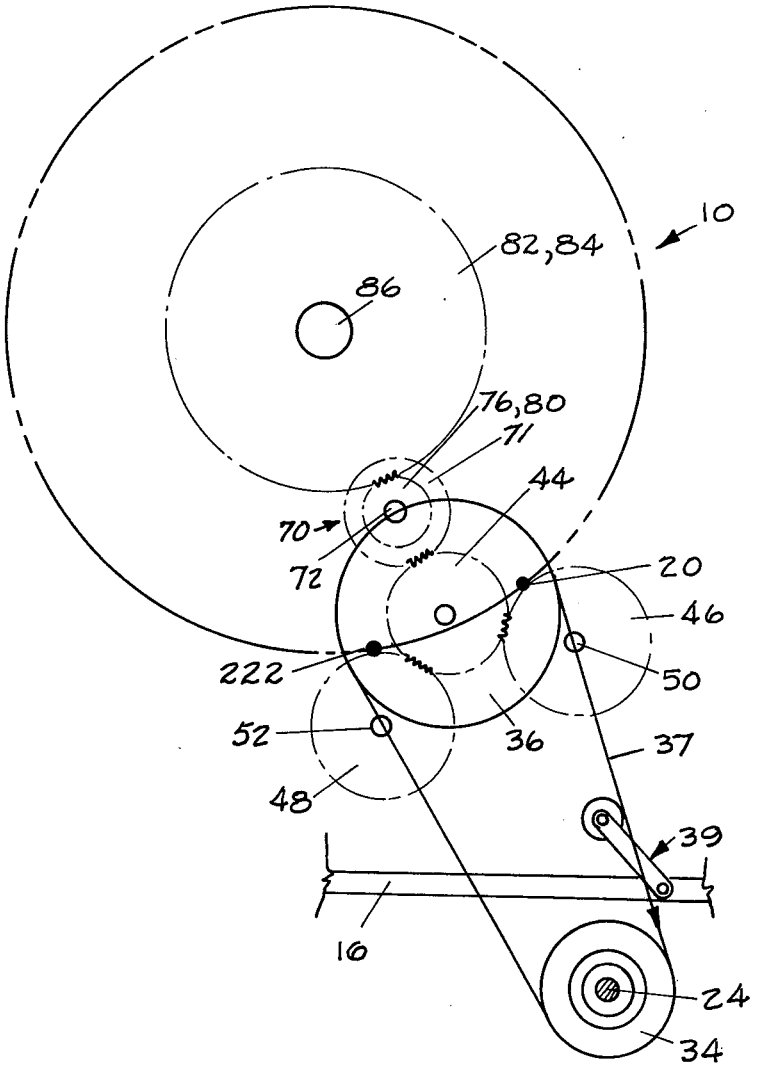
FIG. 3 is a front schematic elevation of the perforating apparatus shown in FIG. 1A illustrating the position of the associated gear and drive mechanism for the perforating drum.

The perforating drum 10 is normally driven by an independent drive mechanism or by the assembler utilizing a clutch mechanism 22 provided on shaft 24 to transmit the rotary motion from the assembler device to the drum gearing system. The shaft 24 is suitably journaled in forward bearings 26 and rear bearing housing 28 which are secured to the support bar 16 and mounting plate 40 by brackets 30 and 32, respectively. Shaft 24 carries a timing belt pulley 34 on its rear end. Another timing belt pulley 36 located above pulley 34 is secured to a spur gear housing 35 by bolt 33. The housing is suitably journaled on stationary shaft 38 which, in turn, is mounted to a mounting plate 40. Plate 40 is secured to the assembler and support legs (not shown). Pulley 34 drives pulley 36 through timing belt 37 while a belt tightener assembly 39 is provided to maintain the proper tension on the belt (see also, FIG. 3).

The mounting plate 40 supports the perforating drum 10 and the entrance transfer drum 14 and the exit transfer drum 42 (see in FIG. 4). Transfer drum 42 is not shown in FIG. 5B but coincides with drum 14 by the rotation in the same axis as the cross-section view which is a standard drawing practice. The transfer drums are identical in configuration; therefore, only one will be described herein.

The spur gear housing 35 which is rotatably mounted on shaft 38 has an inside spur gear portion 44 which meshes with spur gears 46 and 48 (see FIGS. 3 and 5B) that are carried on the shafts 50 and 52, respectively, of the entrance and exit transfer drums. As can be seen in FIG. 5B, the shafts 50 and 52 are suitably journaled in similar elongated bearing housings 54 which extend through and are attached to the mounting plate 40 by bolts 41. The forward end of shafts 50 and 52 carries a vacuum seat assembly 56 which transfers the cigarette to or receives the cigarette from the perforating drum 10. A partial vacuum or negative pressure is applied to the vacuum seats 58 through a bore 57 and groove 59 on the forward end of housing 54, and the annular passage 60 between the inner surface of housing 54 and the shaft 50. Openings 62 near the rear of the housing 54 connect the passageway 60 to a vacuum space or chamber 64 between mounting plate 40 and an intermediate plate 66. Seals 68 are provided at each of the shaft or housing locations which extend through the intermediate plate to maintain the negative pressure in chamber 64. A protective backing plate 69 is spaced rearwardly from the intermediate plate to cover the gears which extend through the intermediate plate.

Spur gear 44 on housing 35 also meshes with the inside gear 71 of dual spur gear 70 (FIGS. 3 and 5B) which is keyed to a rotatable shaft 72. Shaft 72 extends through and is suitably journaled in a housing 74 which is, in turn, secured to mounting plate 40 by bolts 75. Another spur gear 76 is keyed to the forward end of shaft 72 and held in place by nut 78. Spur gear 76 and the outside gear 80 of dual gear 70 mesh with gears 82 and 84, respectively, which drive the rotatable portion of the perforating drum 10 as will be explained hereinafter.

A main shaft 86 of the perforating drum has a rear hub 88 which is fixedly mounted thereto by retainer bar 90 and nut 92. The spur gear 84 mentioned above is fixedly secured to the hub 88 by bolts 94. Located forward of the hub 88 is the central or main bearing housing 96 of the perforating drum which extends through and is mounted on mounting plate 40 by bolts 116. A single bearing 98 is located at the rear end of the housing and double bearings 100 and 102 are located at the forward end of the housing and contact the main shaft 86. The hub 88 and an annular ring 99 secured to the rear of the housing 96 by bolts 101 hold bearing 98 in position. The main shaft 86 has an enlarged portion 104 which acts as a spacer for the rear and forward bearings. There is an annular space 106 between enlarged portion 104 of the shaft 86 and the inner surface of housing 96. Apertures 108 and 110 (see FIG. 5A) are located in the rear and forward ends, respectively, of the housing. Aperture 108 communicates with the vacuum chamber 64 while aperture 110 communicates with a tube assembly or conduit 112 which is connected to a vacuum control segment 148. The vacuum control segment 148 controls the negative pressure or suction applied to the vacuum seat assembly 134 as will be explained hereinafter. Another aperture in the housing 96 and tube assembly (not shown) which is similar to tube 112, is connected to another vacuum control segment 149 (see FIG. 4) as will be explained later.

There are several assemblies and elements which comprise the perforating drum 10 that cooperate to perforate the assembled filter. Some of these assemblies and elements are stationary while others rotate as will be explained hereinafter.

On the outer surface of housing 96 adjacent to mounting plate 40 is a flanged bearing housing 118 which is rotatably mounted on the housing 96 by bearings 120 and 122. An annular spacer 124 is provided between the bearings to maintain separation and proper alignment.

Spur gear 82, previously mentioned hereinabove, is carried on the housing 118 and contacts the rear face of flange 126 and is secured thereto by fasteners 130 (see FIG. 5B). The forward face of flange 126 is contacted by an annular support disc 132 (see FIG. 5A) which carries the vacuum seat assembly 134 and part of a retaining assembly 136 which engages one end of the filter element as will be described hereinafter.

Forward of housing 118 on housing 96 is a flanged hub 138 which is held in place on the housing 96 by key 140 and nut 142. Hub 138 carries a support disc 144 and a cam disc 146 which are fixedly secured thereto by fasteners 145 and 147, respectively. As is apparent in the drawings, the support disc 144 and the cam disc 146 are stationary and do not rotate because they are secured to the hub 138 which, in turn, is secured to the stationary housing 96. The support disc 144 carries the vacuum control segments 148 and 149 (see FIG. 4), which control the suction to the vacuum seats assembly 134, and a purge shoe element 150 (also see FIG. 5B). The cam disc 146 has a plurality of lobes on its peripheral surface which manipulates a perforating plunger assembly 152, as will be explained hereinafter.

Continuing with the description of the perforating drum 10, as seen in FIGS. 5A and 5B, located forward of housing 96 on shaft 86 is a spacer 154 which contacts the outer forward bearing 100 and a support disc 156 for the perforating plunger assembly 152 and another part of the retaining assembly 202. The forward end of the support disc 156 contacts bearing 158 which is positioned in an aperture within a front plate 160. The support disc 156 is fixed to the shaft 86 by retainer bar 162 (see FIG. 5B) and rotates therewith. A nut 164 secures the bearing 158 on the shaft 86 and holds it in position against disc 156.

The forward end of shaft 86 extends through front plate 160 and carries a slip ring 166 which is contacted by brushes 168 and 170. The brushes are carried in brush holders 172 and 174, respectively, which are, in turn, secured by brackets 176 and 178 to the front plate 160. The brush holders have terminals 180 and 182 located thereon which are connected through wires 184 and 186 to a suitable power source (not shown). A cover 187 encloses the slip ring and brush assemblies.

The slip ring 166 carries terminals 188 and 190 having wires 192 and 194 attached thereto. The wires are inserted into a bore 196 which extends rearwardly through the end of shaft 86. Bore 196 extends into the shaft to a point slightly behind the forward plate 160 where it intersects with a radially extending bore 198 perpendicular to the axis of the shaft 86. The bore 198 coincides with an opening 199 through the flange of support disc 156. The wires extend through the bores and are connected to a heater terminal 200 on a perforating plunger assembly 152.

As has been previously mentioned, discs 132 and 156 which carry vacuum seat assembly 134, retaining assemblies 136 and 202 and perforating plunger assembly 152 rotate with and at the speed of shaft 86 while vacuum control disc 144 and cam disc 146 are stationary. Furthermore, as can be seen from the drawing, there are a plurality of working stations on the perforating drum, each consisting of a vacuum seat 114, a first retaining plunger 242, a perforating plunger 206 and a second retaining plunger 208 (see FIG. 6). Each of these perforating stations receives an assembled filter element, and at least one aperture is perforating therein during approximately one revolution of the drum. The number of perforating stations depends on several variables including the speed and diameter of the drum as well as the number of perforations to be made in each filter or mouthpiece.

Figures 6, 7, 13:
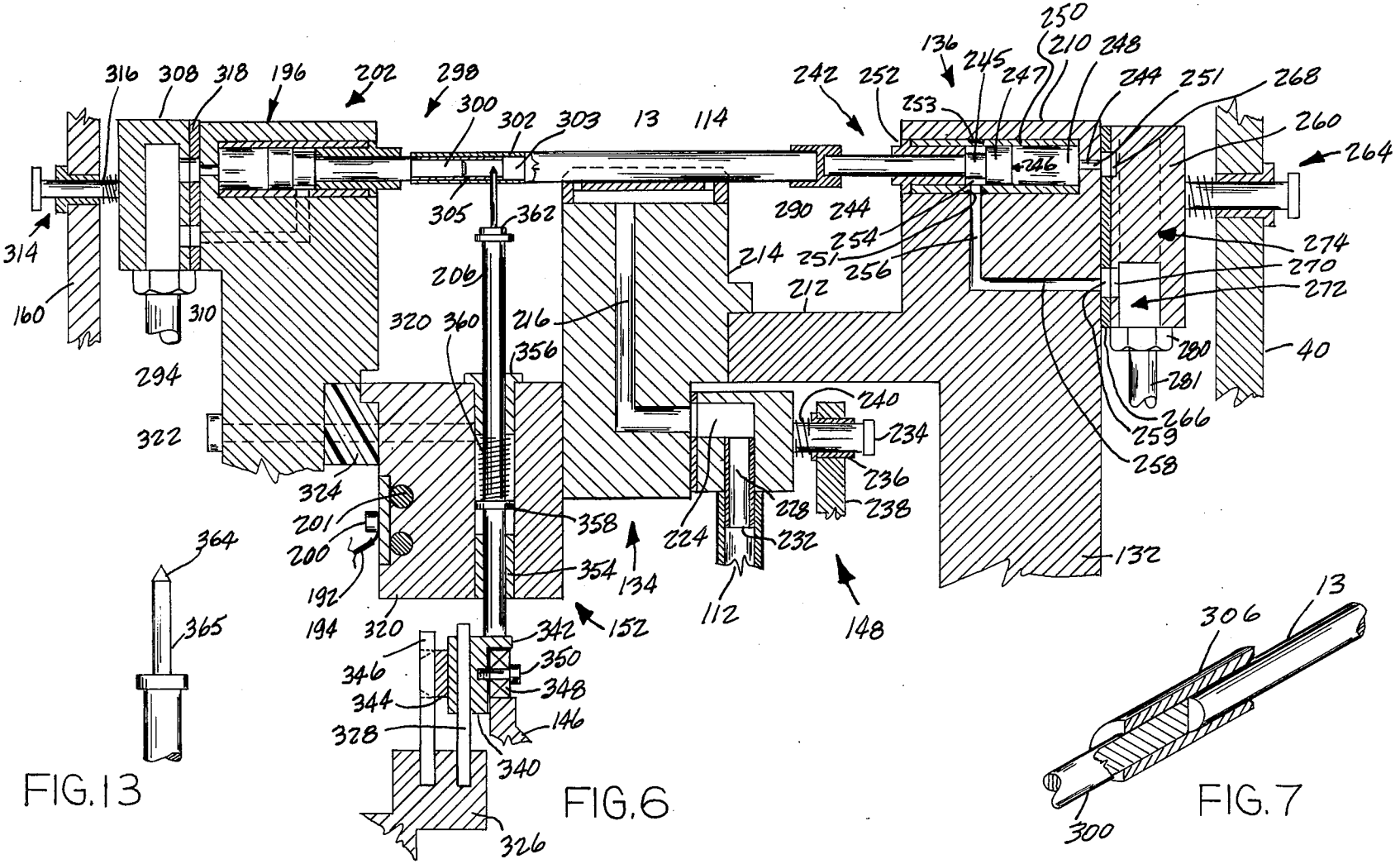
FIG. 6 is a broken-out section of the element retaining mechanisms and the perforating plunger according to the present invention.
FIG. 7 is a broken-out cut-away view of a holding cup which is utilized with non-recessed type filter cigarettes.
FIG. 13 is a detail of one configuration of a perforating needle according to the present invention.

The details of each work station are illustrated in FIGS. 5A and 6. Support disc 132 has an annular enlarged peripheral portion 210, and an annular ring flange 212 extending forward from the front surfaces thereof. The flange 212 has an annular vacuum seat support ring 214 secured to its forward end by suitable fasteners. The vacuum seat support ring carries the vacuum seats 114 which receives the filter elements from the transfer drum 14. At each seat location, a bore 216 extends radially inwardly to a point below the lower surface of flange 212 where it intersects with a rearwardly extending bore 217. Bore 217 has an exit port in the rear surface of the support ring 214. As can be seen in FIGS. 5A and 4, the vacuum control segments 148 and 149 have shoes 218 and 220, respectively, which communicate with the exit ports in the ring 214 to provide a negative air pressure to the seats 114. Shoe 218 provides negative pressure to the seats prior to the entrance point 20 to the perforating drum while shoe 220 provides negative pressure to the seats prior to the exit point 222. A seal element 224 (see FIG. 6), preferably made of carbon, is attached to the face of each shoe to eliminate the necessity of lubricating the contacting surfaces. The vacuum seats are not supplied with a suction between the segments.

Vacuum shoes 218 and 220 have arc-shaped grooves 225 and 226, respectively, (see FIG. 4) on their face which communicate with radial bores 228 and 230. A tubular insert 232 (see FIG. 6) is provided in bore 228 and is attached to previously mentioned tubes 112. Again, it should be understood that, although only one tube 112 is illustrated in FIG. 5A, a similar tube is attached to the shoe 220 and communicates with the vacuum system of the drum in the same manner as tube 112.

Each of the vacuum control shoes is held in position by securing bolt 234 which is threaded into the back of the shoe (see FIG. 6). The bolt 234 is inserted through a bushing 236 which is carried in plate 238 located behind the shoe and carried on disc 144. A spring 240 circumscribing the bolt contacts the rear face of the shoe and the forward face of bushing 236, thereby maintaining the shoe in positive contact with the vacuum drum ring 214 as the carbon seal becomes worn.

The peripheral enlarged portion 210 of the support disc 132 carries a plurality of retaining plungers 242, one of which is illustrated in FIG. 6. The number of holding plungers corresponds to the number of vacuum seats 114. The holding plungers are carried in bore 248 in the enlarged portion 210 which carries a sleeve bushing or liner 250. Each plunger has a stem 244 which is integrally formed to a piston head 246. The piston head has a small forward cylindrical portion 245 and a large rear portion 247. The piston slides within the cylinder containing the liner 250 which is made from a suitable material such as hardened stainless steel. The liner 250 has a circumferential outside groove 253 and a plurality of apertures within the groove. The rear end of the bore is closed and a small vent bore 249 extends from the bore 248 to the rear face of the enlarged portion 210 and exits at port 251. The stem 244 extends through bushing 252 which is inserted in the forward end of bore 248. An annular space 254 exists between the small forward portion 245 of the piston 246 and the liner 250. The forward surface of the forward portion 245 contacts the rear end of bushing 252, thus, controlling the distance the stem protrudes from the enlarged portion 210. Contiguous to the rear end of the bushing 252 and communicating with annular groove 253 in liner 250, a bore 256 extends radially inward from bore 248 and intersects a horizonatlly extending bore 258 which exits at port 259 at the rear of the enlarged portion 210. Bores 249 and 258 are provided to introduce positive air into the air cylinder or bore 248 to manipulate the plunger. The introduction of the air into these bores is controlled by a pair of shoe assemblies 260 and 262 (see FIG. 4) which are secured in position on the back of mounting plate 40.

Each positive air shoe 260 and 262 is supported by a securing bolt 264 which is similar to the bolt assemblies 234 used to support the vacuum control segments 148 and 149 described hereinabove. Therefore, these bolt assemblies will not be discussed in detail.

Each of the positive air shoes 260 and 262 has a carbon seal 266 secured to its forward face which contacts the rear surface of enlarged portion 210. A pair of arc-shaped grooves 268 and 270 are in the forward face of the shoe and are the same radial distance from the centerline of shaft 86 as the exit ports 251 and 259 in the enlarged portion 210. Communicating with the groove 270 is a radially extending bore 272 (see FIGS. 5A and 6), and groove 268 communicates with bore 274 (see FIG. 6). As can be easily understood, depending upon whether the shoe is for extending the plunger or extracting it, one of the bores 272 or 274 is attached to a positive air source.

In shoe 260 (see FIGS. 4 and 6) the bore 274 has a fitting 280 therein which receives tubing 281 that extends from fitting 280 to a second fitting 282 in plate 40 (see FIG. 5A). The tubing 281 extends from fitting 282 to fitting 286 located in the annular cover plate 288 at a point between the mounting plate 40 and intermediate plate 66. From fitting 286, the tubing is connected to a suitable positive air source. Bore 272 in shoe 260 is not connected and is used to vent annular space 254. In shoe 262, the opposite hook-up is utilized. Bore 274 is used as a vent while bore 272 is connected to the positive air supply.

By the above described arrangement, positive air can be supplied to the appropriate side of the piston head 246 so that the plunger can be manipulated. For example, after a cigarette 13 is placed in vacuum seat 114, air is supplied to grooves 268 of shoe 260 and through bore 249. Positive air is introduced to bore 248 through bore 249 causing the plunger 242 to move outwardly so that a cup 290 on the end of the stem 244 captures the tobacco rod end of the cigarette 13. Any air pressure in the annular space 254 is vented by the apertures in groove 253 through bores 256 and 258, groove 270 and bore 272.

Shoe 262, which is located prior to the exit point 222 (see FIG. 4) receives positive air through bore 272. The air is directed into groove 270 through bores 258 and 256 and into the annular space 254. As positive air is supplied to space 254, the piston head 247 is moved rearwardly and retracts cup 290 from the end of the cigarette.

Continuing with the description of the preferred embodiment, support disc 156 has an annular plate 294 secured to its forward surface (see FIG. 5A) by fastener 293. The annular plate has an enlarged portion 296 on its peripheral edge. The enlarged portion 296 carries a plurality of arbor plungers 208 (see FIG. 6) which consists of a piston and stem carried in a cylinder or bore similar to the holding plunger 242 described hereinabove. However, the plunger 208 does not carry a cup in the preferred embodiment but has a tapered, sized end 300 which can be inserted into the recessed end of a filter mouthpiece 302. The arbor is tapered to insure proper insertion of the arbor into the recessed end of the mouthpiece. Mouthpiece 302 is made up of an inner cellulose acetate plug 303 adjacent the tobacco rod and an outer tubular member 305 covered by an overwrap and tipping. It has been found that the tubular member can be made of plastic, paper, etc.; however, preferably the tubular member is made of a plastic material because of its hole configuration retaining characteristics.

Another configuration of the engaging element of plunger 208 is illustrated in FIG. 7. In this configuration, a cup 306 similar to cup 290 on holding plunger 204 is secured to the end of the plunger to receive the end of a non-recessed filter. The diameter of cups 290 and 306 should be slightly greater than (approximately 1/32 in.) the diameter of the tobacco rod or filter, while the diameter of the end 300 of the arbor 208 would be slightly smaller than (approximately 1/32 in.) the inside diameter of the tubular member 305 of a recessed filter. The cups and arbor are merely utilized to capture and retain the ends of the rods a proper position as they are being pierced and are not required to hold the rods firmly.

The arbor plunger 208 is operated in the same meanner as the retaining plunger 242. A pair of positive air control shoes 308 (see FIG. 5A) and 309 (not shown) are provided and are connected to the positive air source through tubing 310 and fitting 312 in the front plate 160. A support bolt 314 (two for each shoe) similar to bolts 264 hold the shoes in position. A spring 316 is provided and maintains the carbon seal 318 on the shoes in contact with the face of the enlarged portion 296 (see FIG. 6). The angular position of the shoes 309 and 308 corresponds with the position of shoes 260 and 262, respectively, which can be seen in FIG. 4 so that the arbor plunger 208 will be manipulated to be inserted and extracted from the recessed end of the filter 302 at the same time cup 290 engages and disengages from the tobacco rod end of the cigarette 13.

The support disc 156 carries a perforating ring 320. The perforating ring is secured to annular disc 294 by bolts 322. An insulator ring 324 separates the annular disc 294 from the perforator ring 320. As has been previously mentioned, heater wires 192 and 194 are attached to terminals 200 of heater elements 201 which are carried on the perforator ring.

The support disc 156 has a rearwardly extending flange 326 (see FIG. 5A) around its periphery which carries a plurality of radially extending studs or posts 328. Each post or stud carries a reciprocating block 340 (see FIG. 6) which has a rearwardly extending upper lip 342. Extending forwardly from each block is a fork 344 which contacts a guide post 346 that is also secured to support disc flange 326. Also, secured to the rearward side of each block, there is a cam wheel or follower 348 which is suitably journaled on a shaft 350. The cam wheel 348 contacts the peripheral surface of cam disc 146 and, thus, the block 340 is reciprocated radially as the cam wheel travels over the cam disc surface.

Resting on the upper surface of lip 342 of each block 340 are two perforating plungers 206 (see FIG. 4). Although there are the same number of perforating plungers as there are vacuum seats, there are only half as many blocks 340. The perforating plungers extend through bores in the perforating ring 320. Each bore has a bottom liner 354 and an upper bushing 356. The plunger has an enlarged shoulder 358 with a compression spring 360 positioned between the end of the bushing 356 and the enlarged shoulder 358 to maintain the plunger in contact with the block 340 as the cam wheel moves over the cam disc 146.

Threaded into the upper end of the plunger 206 is a perforating element or a threaded needle holder 362. Preferably, the needle has a tapered end 364 with a uniform cross-section body 365, (see FIG. 13). This configuration insures that each hole in the filter wall will be of a uniform size regardless of the distance the needle is inserted into the filter as long as the tapered end of the needle penetrates the filter past the tipping and the tubular member 305. By maintaining a precise hole size, the flow rate of the dilution air and the pressure drop across the filter can be accurately controlled.

Although holes can be perforated in the cigarette filter without the use of a heated piercing probe or needle, it has been found that more uniformed holes are formed if the needles are maintained at a temperature of between 120° F. and 145° F., preferably about 135° F., particularly where the recessed filter mouthpiece being perforated has a plastic tubular member. If the needles are maintained at approximately 135° F., the dwell time of the needles in the holes must be approximately 0.3 sec. It should be understood that the above is only one set of specifications and that the particular temperature and dwell time of the needles in the holes depend on the material being perforated and the speed of the drum. Although the temperature can vary due to a multitude of conditions, it is very important to maintain the selected temperature of the needles. In order to maintain the correct temperature range for the needles 362, a sensor element 368 (see FIG. 5B) is attached to support disc 144 and contacts the surface of the perforating ring 320. A control wire 370 is attached to the sensor and extends through bores in housings 138 and 96, annular space 106 and a rear bore 372 in housing 96 to a connector (not shown) in annular cover plate 288. Another wire 374 connects the connector to the temperature control system (not shown) for the heater elements 201. The typical control circuit is known in the art and is not considered to be part of this invention; however, controlling the temperature of the perforating needles is necessary in certain instances to produce a uniform result.

Also secured to disc 144 is a bracket 376 (see FIG. 5B) which carries the purge nozzle 150. The position of the port of the purge nozzle coincides with the exit ports of the bores 217 in vacuum drum ring 214. A fitting 378 is attached to the element and has tubing 380 extending therefrom through an opening 382 in the sensor bracket, bores in housings 138 and 96, annular space 106, and a rear opening in housing 96 to a fitting (not shown) in the annular cover plate 288. From the fitting in the cover plate 288, tubing 384 is attached to a positive air supply. The purge shoe is located between vacuum control shoes 218 and 220 (see FIG. 4) so that positive air is directed into the vacuum seat 114 after the cigarette has been removed therefrom by the exit transfer drum 42. The positive air purges any contaminant such as tobacco, paper, etc., from the seat prior to another cigarette being placed thereon by entrance transfer drum 14.

Although as has been previously mentioned, the perforator drum can be utilized to form one perforation in each cigarette filter by adding one or more turning mechanisms 390 and a plurality of lobes on cam disc 146, a plurality of perforations can be made in the filter by the above-described perforating drum.

In the preferred embodiment illustrated in the drawings, the perforator drums will form three perforations in a filter cigarette. Therefore, three cam lobes 392, 393, 394 are requred to reciprocate the perforating plunger 206 (see FIG. 4). There will always be one less turning mechanism 390 than the number of lobes since one of the perforations would be made in the filter in its initial position on the vacuum seat.

Figure 10:
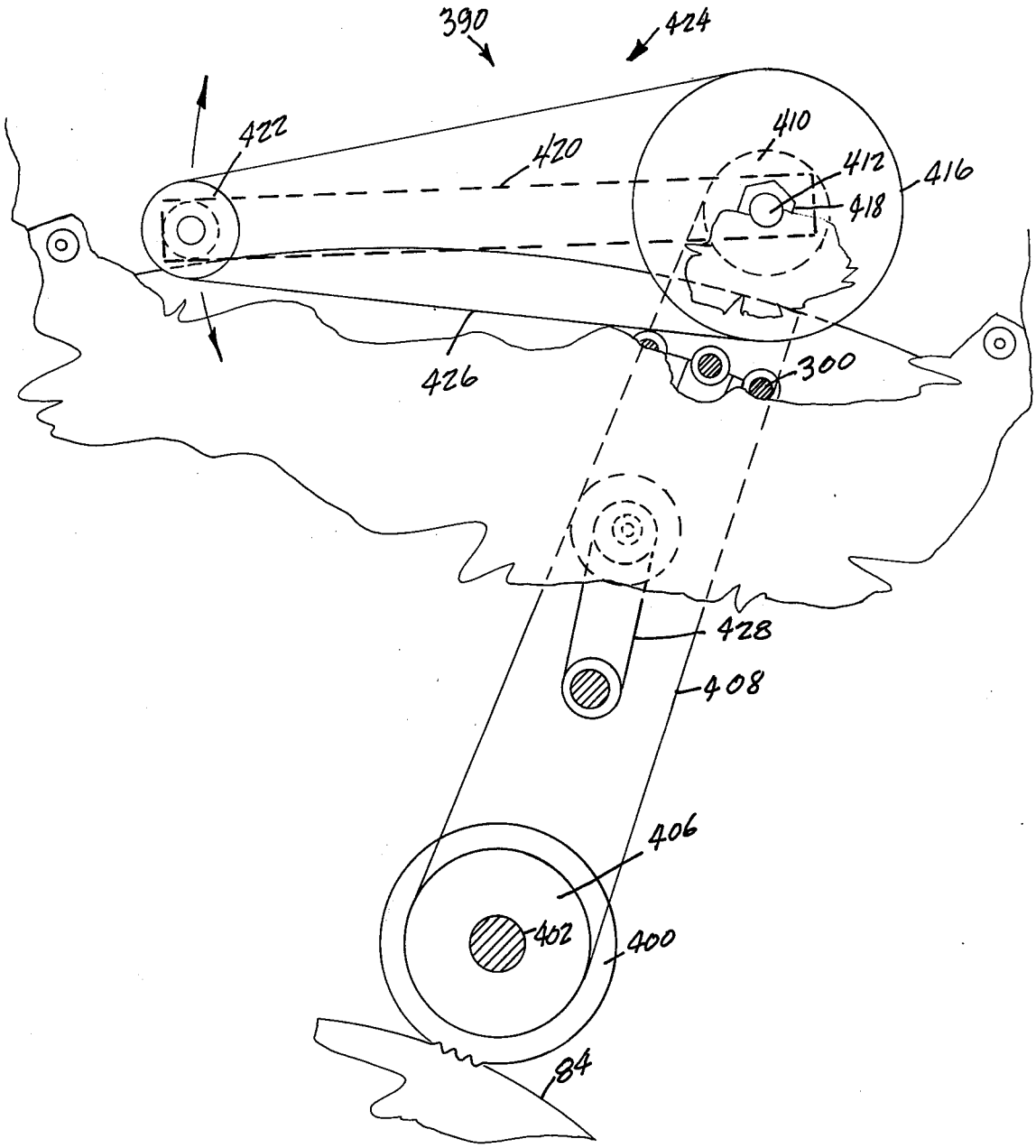
FIG. 10 is a broken-out detail view of one embodiment of the turning device according to the present invention.

Turning now to the preferred embodiment of the turning mechanism, illustrated in FIGS. 4, 5A and 10, one turning mechanism 390 is located on the drum between the end of cam lobe 392 and the beginning of lobe 393, while the other turning mechanism is located similarly between lobes 393 and 394. Depending on the angular speed at which the drum is driven and the number of perforations desired, the shape and length of the lobes on the cam disc can be determined. As can be easily understood, if there is more than one perforation to be formed in the filter, the perforation will normally be equally spaced around the filter. For example, if three perforations are made, they would be 120° apart. Although the equal spacing would be the normal configuration for the filters, it should also be understood that such a configuration is not absolutely necessary. If the position and number of perforations desired in the filter are known, it is within the skill of the art to determine the location and position of the cam lobes and turnig devices as well as the length of the cam lobes and the length of the dwell time between lobes.

Each of the turning devices 390 is driven by spur gear 84 which is rotated by the main shaft 86. The spur gear 84 meshes with a spur gear 400 which is carried on shaft 402. Shaft 402 is suitably journaled in a housing 404 which, in turn, is secured to back plate 40 and extends through intermediate plate 66. The shaft 402 also carries a timing belt pulley 406 which has a timing belt 408 encircling it and extending to the periphery of the drum to circumscribe a timing belt pulley 410 carried on shaft 412. Shaft 412 is suitably journaled in an elongated housing 414 which extends forwardly through the intermediate plate 66 and the back mounting plate 40 to a position adjacent the outer end of the vacuum seat 114. Shaft 412 carries a flat-surfaced pulley wheel 416 on its forward end that is secured to the shaft by nut 418. Clamped to the end of housing 414 is a lever arm 420 which carries a pulley 422 at its free end. Surrounding pulleys 416 and 422 is a flat pulley belt 424. The lower reach 426 of the pulley belt 424 is contiguous to the upper surface of the sized end 300 or arbor 298. The position of lever arm 420 is angularly adjustable and, thus, the point at which the filter is engaged by belt 424 and the length of time at which the belt engages the filter can be varied. With the adjustable feature of the turning device, the filter can be rotated any angular distance desired. It is preferred that the belt speed be slower than the peripheral drum speed to obtain the turning action of the filter element. As previously mentioned, the sized arbor end is slightly smaller than the inside diameter of the recessed filter providing a loose fit; therefore, upon engagement of the filter by the belt, the filter will turn on the arbor. Although belts having other types of cross-sections will function properly, it has been found that a flat belt 424 is preferable since it will give a larger area of contact which insures that the filter turns properly. It has also been found that, in order to control and obtain a uniformed angular movement, the turning device should be positively driven by the same drive mechanism as the perforating drum. A belt tightener 428 is secured to the intermediate plate and permits any tension on belt 408 to be adjusted.

OPERATION OF THE PREFERRED EMBODIMENT

Turning now to a brief description of the operation of the preferred embodiment, a filter rod or a filter cigarette from the entrance transfer drum 14 is placed on vacuum seat 114 after a suction has been applied to the seat through shoe 218 (see FIGS. 4, 5A and 6). As the support discs 132 and 156 rotate, the plunger 242 of the holding plunger assembly 136 and the arbor 208 of the arbor plunger assembly 202 are operated by positive air through shoes 260 and 308. The plungers move outwardly so that cup 290 engages the end of the filter rod or tobacco rod (see FIG. 6), while the arbor is inserted into the recessed end of the mouthpiece. The perforating plunger assembly 152 which is connected to disc 156 rotates, causing cam follower 348 to engage lobe 392 on stationary cam disc 146. The perforating plungers 206 are moved outwardly and needles 362 pierce the corresponding mouthpieces 302 to form a perforation. As previously mentioned, mouthpiece 302 can be a recessed filter as shown in FIG. 6, or a non-recessed filter as shown in FIG. 7. Furthermore, the rods being pierced can be on assembled cigarettes or completely assembled 4-up or 6-up filter rods made by a plug tube combiner or filter making machine. If the mouthpiece is a recessed mouthpiece, the arbor is used not only to support the end of the filter but also prevent the recessed portion of the filter from collapsing or bending as the needle 362 is inserted in the filter.

As the drum continues to rotate, return spring 360, which holds the cam follower in contact with the cam 146, causes the plungers 206 to retract and the piercing probes 362 to be extracted from the mouthpiece as the cam race goes from a high dwell (lobe) to a low dwell position. While in the low dwell position, the filter cigarettes or filter rods which are held loosely by cup 290 and arbor 300 are engaged by the belt 424 of turning device 390 and are rotated approximately 120°. Upon completion of this angular movement, the cam follower wheel 348 engages a second lobe 393 causing the plungers 206 to again move outwardly and pierce the filter a second time. The same operation occurs with respect to the second turning device 390 and cam lobe 394. At the end of cam lobe 394, a suction is re-applied to seat 114 through shoe 220 and positive air is applied to the annular space 254 of the retaining plunger assemblies - cup plunger 242 and arbor plunger 208. The air to the rear of piston head in bore 248 is vented through bore 249, and the positive air which is directed into the annular spaces 254 retracts the arbor and cup away from the ends of the element. As vacuum ring 214 passes shoe 220, the suction is released from seat 114, whereby the cigarette may be captured by exit transfer drum 42. The exit port of bore 217 on the vacuum ring 214 passes purge element 150 so that positive air can be applied to the vacuum seat 114 to remove any contaminants therein.

ANOTHER EMBODIMENT

Figure 8:
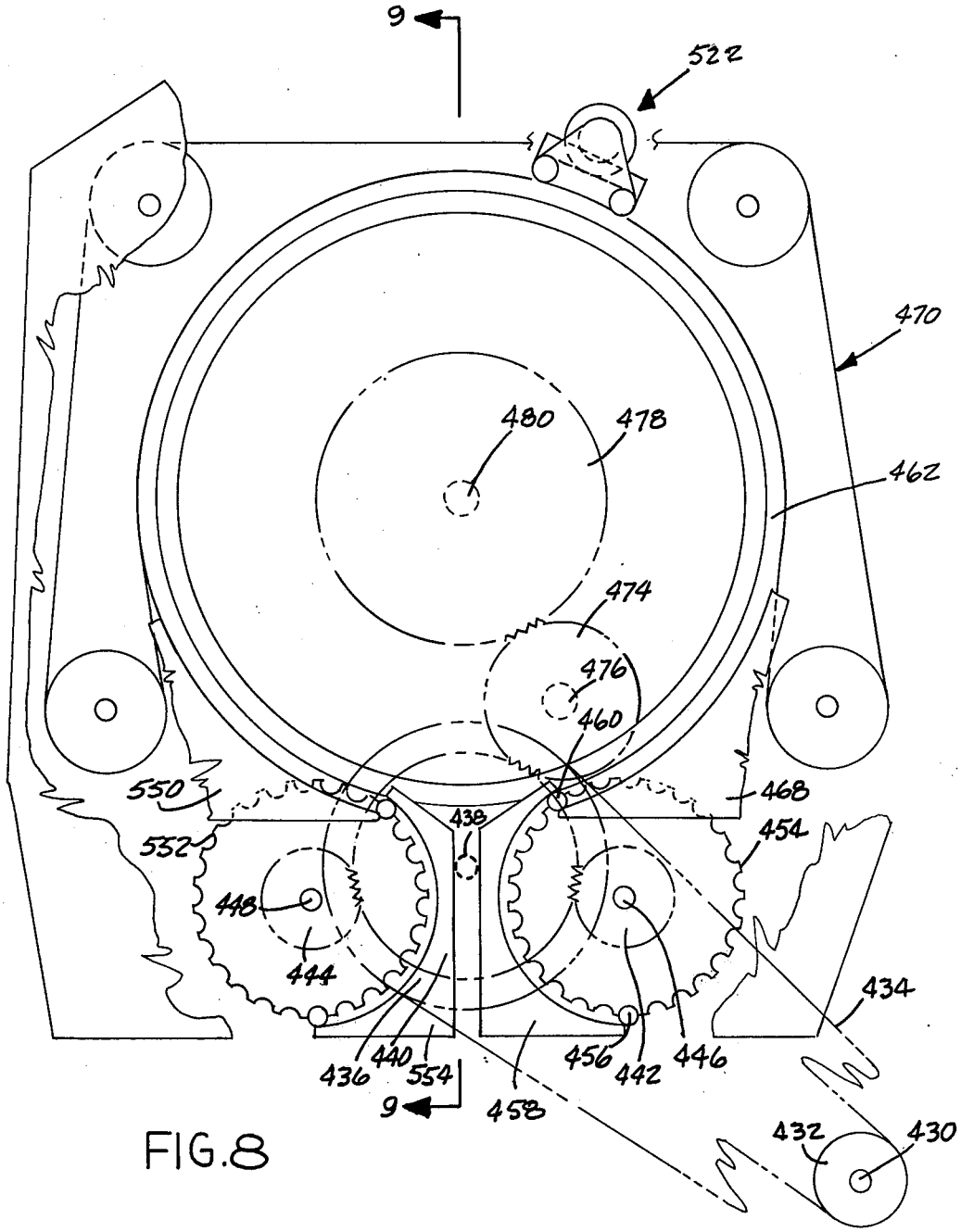
FIG. 8 is a front elevation view of another embodiment of the perforating apparatus as shown in FIG. 1B according to the present invention.
Figure 9:
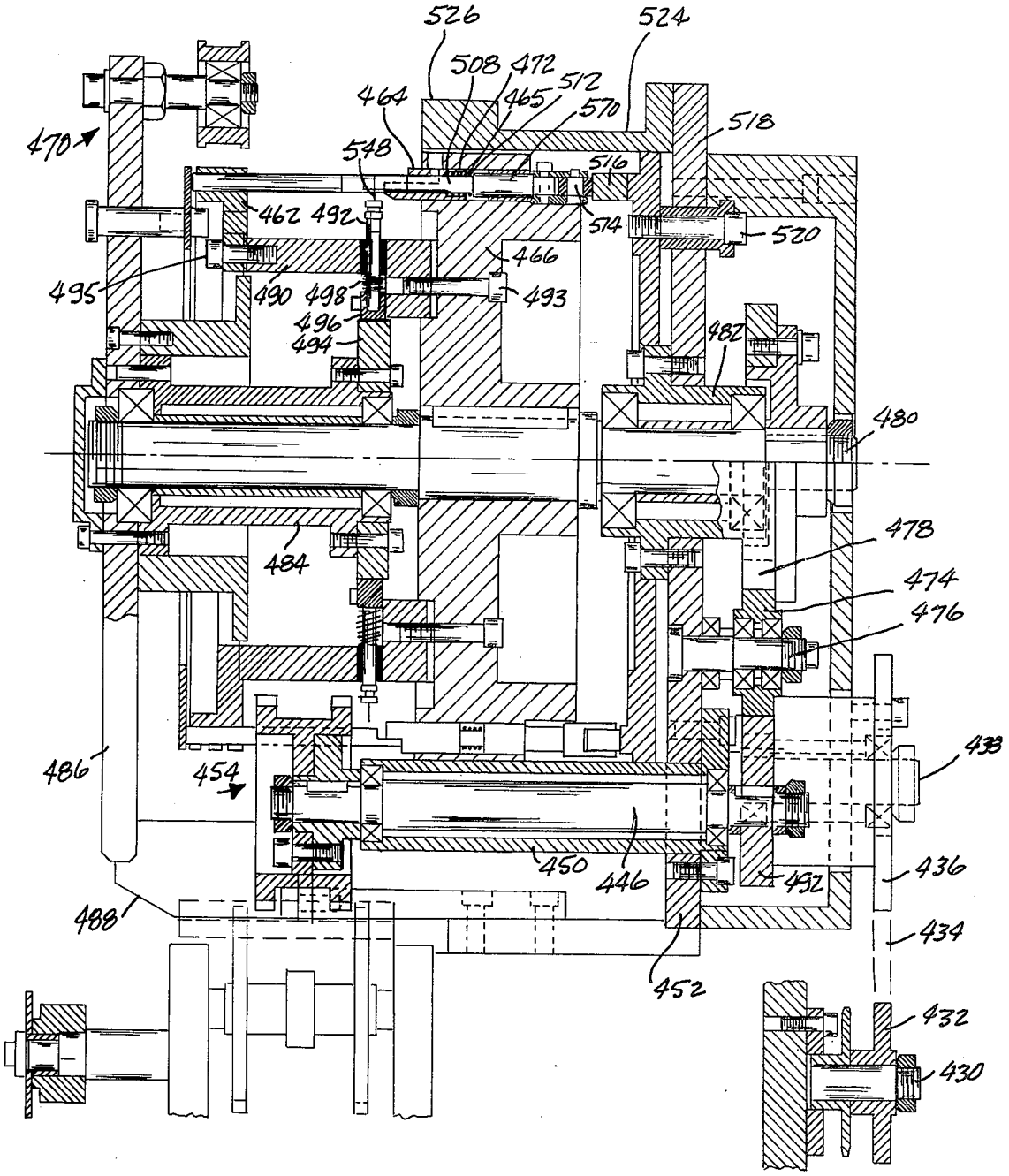
FIG. 9 is a section view taken along line 9—9 of FIG. 8.

Although the above description is of a preferred embodiment, another embodiment of the perforating drum is illustrated in FIGS. 8 and 9.

This alternate embodiment of the perforating drum is primarily for use at slower speeds because of the end capturing mechanisms.

FIGS. 1B, 2B, 8 and 9 illustrate the second configuration of the perforating drum 12 which is mounted on and driven directly by a filter cigarette assembler. An existing shaft 430 on the assembler is provided with a timing belt pulley 432 which is circumscribed by a timing belt 434. The timing belt also circumscribes pulley 436 which is carried on shaft 438. Shaft 438 carries a spur gear 440 which meshes with gears 442 and 444 carried on shafts 446 and 448, respectively. The shafts extend forwrdly through housing 450 and 450' (not shown) which are secured to back mounting plate 452. Shaft 446 carries an entrance transfer drum 454 which receives the cigarettes 456 from a drum or conveyor on the assembler. The filter cigarettes are held on the transfer drum by a guide rail 458 until they reach transfer point 460 where the tobacco rod is placed in one of a plurality of pockets on a drum or support ring 462, and the mouthpiece end is placed in one of a plurality of seat sleeves 464 carried in bores 465 on seat drum 466. The pockets and seats are slightly oversized (approximately 1/32 in.) to provide a loose fit and allow the cigarettes to be turned more easily. The cigarette is held on the support ring 462 and drum 466 by guide rail 468 until hold-down belt assembly 470 engages the tobacco rod end of the cigarette and an arbor 472 is inserted into the recessed end of the filter, which is similar to the arbor assembly described above in the preferred embodiment. However, this configuration of the arbor does not use an air cylinder.

Spur gear 440 also meshes with idler gear 474 which is journaled on shaft 476. Shaft 476 is suitably secured to mounting plate 452. Spur gear 474 drives spur gear 478 which is suitably secured and keyed to shaft 480. Shaft 480 extends forwardly through housing 482 and is suitably journaled therein (see FIG. 9) while the housing is secured by suitable fasteners to mounting plate 452. The seat drum 466 is keyed to shaft 480 and, thus, rotates therewith. The forward end of shaft 480 extends into and is journaled in stationary housing 484 secured to forward plate 486 which is, in turn, attached to the drum support frame 488.

A plunger ring 490 having a plurality of perforating plungers 492 is secured to the drum 466 by bolts 493 and support ring 462 is secured to the forward end of plunger ring 490 by fasteners 495. Therefore, both plunger ring 490 and support ring 462 rotate with the seat drum 466.

Two cams are provided to operate the perforating plunger 492 and the arbor 472. The plunger cam disc 494 is secured to the rear end of housing 484 and is, therefore, stationary. Each plunger has a hardened steel pad 496 secured to its lower end that rests on the peripheral surface of cam disc 494. A spring 498 positioned between the hardened pad and the lower surface of the plunger ring 490 causes the plunger to remain in contact with the cam disc.

Figure 14:
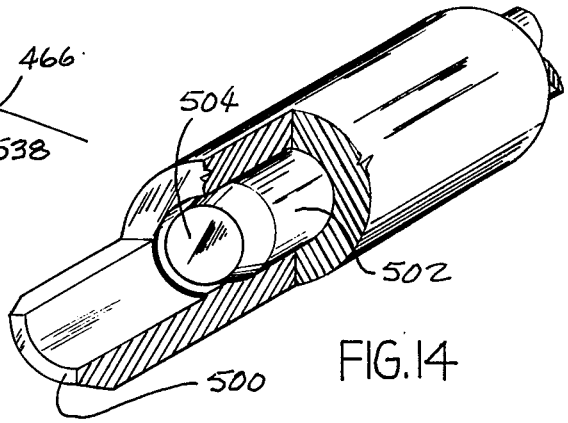
FIG. 14 is a detailed perspective of a seat element utilized in the perforating apparatus shown in FIG. 8.

Each seat sleeve 464 has generally a semi-circular lip or trough 500 (see FIG. 14) into which the recessed mouthpiece is placed. Each seat has a central bore 502 through which a tapered, sized end 504 of an arbor plunger 472 is inserted. The arbor plunger 472 has a stem 508 and an enlarged cylindrical portion 510. The stem is inserted into the central bore 502 and the enlarged portion extends through the bore 465. A spring 512 is provided within a cavity at the rear end of seat sleeve 464 and the forward end of the enlarged portion 510 to insure that the cam follower 514 of the arbor plunger remains in contact with a race 516 on a cam disc 518. Cam disc 518 does not rotate since it is secured by a plurality of adjusting bolts 520 to the mounting plate 452. The adjustment bolts permit lateral adjustment of the cam race to allow for adjustment of the distance the tapered end 504 of the arbor plunger is inserted into the recessed mouthpiece.

Figure 11:
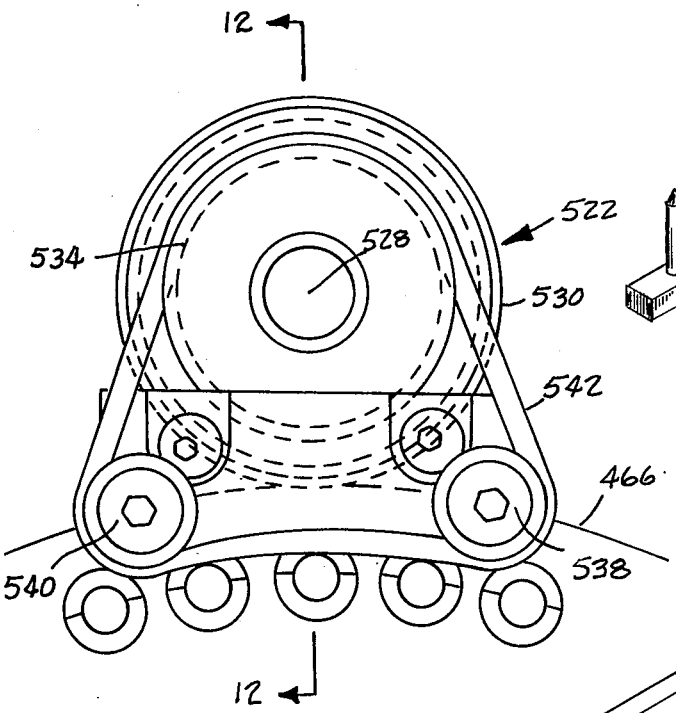
FIG. 11 is a front elevation view of another embodiment of the turning device according to the present invention which can be utilized with the perforating unit illustrated in FIG. 8.
Figure 12:
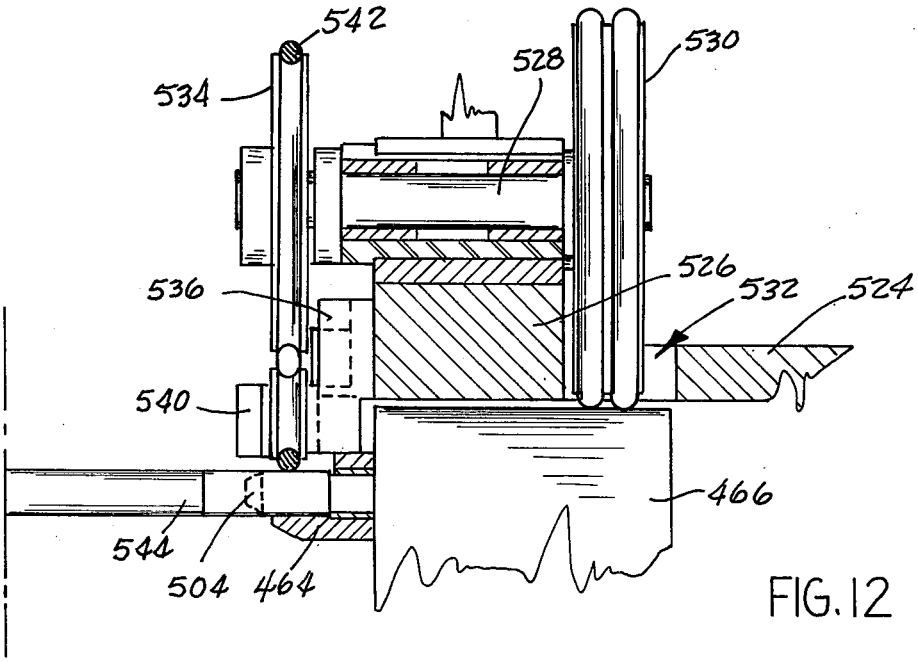
FIG. 12 is a section view taken along line 12—12 of FIG. 11.

Although the turning device 390 illustrated in FIG. 10 can be used with this embodiment, another embodiment of the turning device 522 illustrated in FIGS. 11 and 12 is more applicable to this type of drum design. Only one turning device 522 is shown in FIG. 8; however, any number can be utilized depending upon the number of perforations to be made and the configuration of the mouthpiece.

The turning device 522 is carried on an annular cover flange 524 (see FIG. 12) which extends outwardly to the edge of the drum 466 and is fixedly secured to mounting plate 452. The outer end of the flange has an enlarged portion 526 which has a shaft 528 suitably journaled therein. The rear end of the shaft carries a friction wheel 530 which contacts the peripheral surface of drum 466 through opening 532 in flange 524, whereby the shaft 528 is driven by drum 466. The shaft 528 also carries a large pulley wheel 534 on its forward end.

Attached to the front face of the enlarged portion 526 is a bracket plate 536 which carries a pair of spaced pulley wheels 538 and 540. The pulley wheels extend outwardly over the lip of seat sleeve 464. A circular cross-section belt 542 circumscribes the pulleys and contacts the periphery of the mouthpiece 544 as the drum rotates causing the cigarettes to turn angularly a selected distance due to the differential speed between the periphery of the drum and the belt. The pulleys 538 and 540 are vertically adjustable to permit a variation in the time the belt 542 contacts the cigarette.

OPERATIONS OF THE EMBODIMENT ILLLUSTRATED IN FIGS. 8, 9 AND 11

The embodiment illustrated in FIGS. 8, 9 and 11 disclose the basic elements required for perforating a mouthpiece, for example, a means for holding the cigarette in place on the drum and a piercing device to perforate the mouthpiece perpendicular to the axis of the cigarette filter. Additional elements such as an arbor is required when the mouthpiece is recessed or a turning mechanism is utilized when more than one perforation is to be made.

In operation, the cigarette 456 is picked up by transfer drum 454 (see FIG. 8) and placed in a pocket on drum 462 and in the corresponding seat sleeve 464 of drum 466. As the drum continues to rotate, the cigarette is held on the drum by guide 468. The arbor plunger 472 is moved outwardly by cam wheel 514 following the cam race 516 so that the tapered end 504 of the arbor is inserted into the recessed mouthpiece. Hold-down belt system 470 engages the peripheryy of the tobacco rod end of the cigarette to hold the cigarette within the pockets in the drum 462.

As the drum continues to rotate, the cam follower 496 engages a lobe on cam disc 494 and forces the piercing plunger 492 outwardly so that needle 548 pierces the mouthpiece. As the lobe terminates, spring 498 retracts the needle and the filter rod or cigarette is engaged by belt 542 of the turning device 522. The filter rod is turned a selected angular distance by the turning device and the cam follower 496 of the plunger 492 again contacts a lobe on cam 494 causing the plunger 492 to move outwardly, whereby the needle 548 pierces the filter to form another perforation. One or more turning devices can be utilized and the number of lobes of the cam 494 depend on the number of perforations desired.

The cigarette continues around the drum and is eventually engaged by guide 550 which holds the cigarette on the drum as it contunues to rotate. The arbor plunger 472 is retracted by a spring 512 so the cigarette is free to be picked up by transfer drum 552 as it is engaged by guide 554. In this embodiment, the piercing plunger is not heated; however, when the mouthpiece is made of a material such as plastic for best results, the plungers should be heated.

It should be understood that the above-described and illustrated embodiments of this invention are normally used to perforate assembled filter cigarettes including a filter and a tobacco rod. However, the principle of the invention can also be used to perforate assembled filters prior to their attachment to the tobacco rods. These assembled filters could be manufactured by a multi-filter and plug-tube combining machine manufactured by Molins Machine Company Limited or a regular filter making machine such as a Hauni KDF-2 filter rod machine manufactured by Hauni-Werke Korber & Co. Either of these machines can produce an assembled filter by simply making the final overwrap on the filter rod the tipping paper. The 4-up or 6-up filters (multipe filter rods containing 4 or 6 single filters) produced by these machines would then be transported to the assembler machine where they would be cut to proper length and attached to the tobacco rod. However, rather than using the tipping to attach the filter to the tobacco rod, a narrow uniting band would be used in place of the normal tipping paper.

Figure 15:
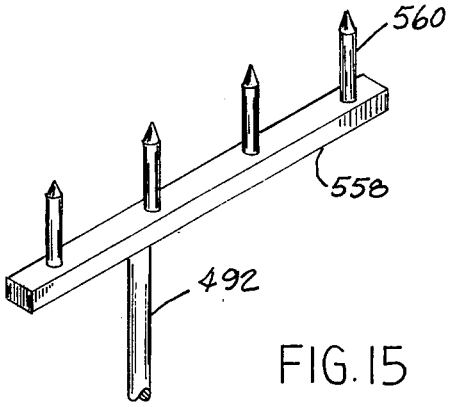
FIG. 15 is a detail of another configuration of the piercing element according to the present invention.

If the perforating drum were used with a plug tube combiner or filter making machine, it would normally be a separate unit and would receive the 4-up or 6-up filter rods from the combiner or filter maker. The only modification to the drum shown in FIG. 9 which would be required other than changes in the size and location of elements because of the different lengths of the 4-up and 6-up filters would be in the piercing element. One embodiment is illustrated in FIG. 15 which shows bar elements 558 secured to the end of the plunger 492 having a plurality of spaced needles 560 depending on the configuration of the filter rod. For example, if a 4-up filter rod section were being perforated, four needles on each bar would be required. The drum could function in the same manner as the above-described embodiment. The hold-down devices, either arbor, cup or belt, would depend on whether the end of the sections were recessed or not. Although the use of the bar with the plurality of needles utilized with the drum illustrated in FIG. 9 would be the simplest method, the same results could be accomplished by utilizing more than one plunger and a plurality of cams to reciprocate the plungers. This could also be done on the drum disclosed in FIGS. 5A and 5B by relocating the vacuum control segment 148 below the vacuum ring 214 and utilizing plungers on both sides of the vacuum seat ring.

It can be seen from the above description of the drawings, the apparatus and method described hereinabove provides for a unique means in which a cigarette mouthpiece can be perforated after the tipping has been applied to the filter element. It furthermore provides an apparatus which can be utilized with new generation high speed assemblers and will give a uniformed air-dilution rate for each cigarette. The turning mechanism permits a number of perforations to be formed and can be used with both a recessed and non-recessed filter. But, primarily the method and apparatus provides a means for accurately controlling and varying the amount of dilution air to be introduced into a cigarette while it is being smoked. By having an apparatus and method for perforating an assembled product which provides a uniform level of air dilution, two of the major problems of air dilution cigarettes can be overcome, namely, the gluing problem produced due to the pattern gluing technique and the porous overwrap breakage problem.

As will be apparent to those skilled in the art, there are many variations and changes which can be made to the apparatus as defined hereinabove without departing from the invention described herein. For example, the configuration of the drum rings can be changed, the variation in the material used in the manufacture of these parts can be made, various types of hold-down devices can be utilized, etc.; however, these variations and changes of this nature can be made in the above-described and illustrated inventions without departing from the true spirit and scope thereof as defined in the following claims.

I claim:

1. An apparatus for perforating apertures in the peripheral wall of an assembled filter element used on a smoking product, comprising:
   (a) a conveying means for receiving and continuously moving a plurality of assembled filter elements;
   (b) means for retaining said assembled filter elements on said continuously moving conveying means;
   (c) perforating means adjacent to and moving with said conveying means for piercing the assembled filter elements, said perforating means forming an aperture in the wall of said filter elements; and
   (d) means for manipulating said perforating means so that said perforating means engages and disengages said assembled filter element.

2. The apparatus of claim 1, wherein said means for retaining said assembled filter element includes:
   (a) entrance and exit holding means to hold said filter element on said continuously moving conveyor means for a selected distance after the entry point to said conveyor means and for a selected distance prior to the exit point of said conveying means; and
   (b) intermediate retaining means which engage the ends of the assembled filter elements between the entrance and exit holding means and permit said filter elements to be rotated about their axes.

3. The apparatus of claim 2, wherein said intermediate retaining means includes:
   (a) means for engaging the ends of said assembled filter elements;
   (b) first and second plunger means located on opposite sides of said conveyor means and carrying said engaging means; and
   (c) means for reciprocating said plunger means, whereby said engaging means contact said assembled filter elements.

4. The apparatus of claim 3, wherein said engaging means includes a cup holder on each of said first and second plunger means, said cup holders receiving each end of said assembled filter element.

5. The apparatus of claim 3, wherein said assembled filter element has at least one recessed end and wherein said means for engaging includes:

(a) an arbor on said first plunger means which is inserted into the recessed end of said assembled filter element; and (b) a cup holder attached to said second plunger means into which the other end of said assembled filter element is inserted.

6. The apparatus of claim 5, wherein said arbor is tapered.

7. The apparatus of claim 1, further including at least one turning means for engaging and rotating said assembled filter element a selected angular distance of less than 360° and wherein said manipulating means causes said perforating means to engage the assembled filter element at least twice.

8. The apparatus of claim 7, wherein said turning means include:

(a) first pulley means positioned adjacent to said conveying means;

(b) second pulley means spaced from said first pulley means and positioned adjacent said conveying means;

(c) means for adjusting the position of said second pulley means with respect to said conveying means;

(d) a belt circumscribing said first and second pulley means wherein said lower reach of said belt contacts said assembled filter element for a selected distance to turn said assembled filter element while on said conveying means; and (e) means for driving said first pulley means.

9. The apparatus of claim 8, wherein said belt means has at least one flat surface which contacts said assembled filter element.

10. The apparatus of claim 8, wherein said drive means includes a gear and timing belt means which is driven directly by said conveying means.

11. The apparatus of claim 1, further including:

(a) means for heating said perforating means to a selected temperature; and (b) means for controlling the temperature of said heating means.

12. The apparatus of claim 1, wherein said perforating means includes:

(a) a plurality of reciprocal plungers positioned at right angles to the axis of said assembled filter elements;

(b) a rotatable support ring for carrying said reciprocal plungers; and (c) piercing elements attached to each of said plungers.

13. The apparatus of claim 1, wherein said means for manipulating said perforating means includes:

(a) cam follower means attached to said perforating means;

(b) cam means having at least one lobe for causing said perforating means to engage said assembled filter elements; and (c) means for maintaining said cam follower in contact with said cam means.

14. The apparatus of claim 12, wherein said piercing element is a single needle having a tapered tip and a body with a uniform cross-section.

15. The apparatus of claim 12, wherein said piercing element includes a bar carrying a plurality of needles, said bar being generally parallel with the axis of said assembled filter element.

16. The apparatus of claim 2, wherein said conveying means includes rotatable drum means having a plurality of vacuum seats thereon and said entrance and exit holding means includes vacuum control means adjacent said drum for controlling the negative pressure to said vacuum seats, whereby a negative pressure is applied to said vacuum seat for a selected distance beyond the entry point of said filter element on said drum and prior to the exit point of said filter element from said drum.

17. The apparatus of claim 16, wherein said intermediate retaining means includes:

(a) means for engaging the ends of said filter elements;

(b) a plurality of first and second plunger means located on opposite sides of said rotatable drum for carrying said engaging means; and (c) means for reciprocating said first and second plunger means, whereby said engaging means contact the ends of said assembled filter elements.

18. The apparatus of claim 17, wherein said assembled filter element has at least one recessed end and wherein said engaging means includes:

(a) tapered arbors formed integrally with said first plunger means which are inserted into the recessed ends of said assembled filter elements; and (b) holding cups attached to said second plunger means into which the other end of said assembled filter element is inserted.

19. The apparatus of claim 18, wherein said perforating means includes:

(a) a plurality of reciprocal plungers, each positioned at right angles to the axis of said assembled filter elements;

(b) rotatable support rings for carrying said reciprocal plungers; and (c) piercing elements attached to said reciprocal plunger means.

20. The apparatus of claim 19, wherein said means for manipulating said perforating means includes:

(a) cam follower means attached to said plunger means;

(b) cam means having at least one lobe for causing said perforating means to engage said assembled filter element; and (c) means for maintaining said follower means in contact with said cam means.

21. The apparatus of claim 20, further including at least one turning means for engaging and rotating said assembled filter element a selected angular distance while on said conveying means after one aperture has been formed in said filter element and wherein said cam means includes at least a second lobe for manipulating the perforating plunger after the assembled filter element has been turned.

22. The apparatus of claim 1, wherein said assembled filter element includes a filter attached to a tobacco rod.

23. The apparatus of claim 22, wherein said filter has a recessed end.

24. The apparatus of claim 1, wherein said assembled filter element is a plurality of singled mouthpieces integrally formed together.

* * * * *